United States Patent [19]

Murphy

[11] Patent Number: 4,893,362

[45] Date of Patent: Jan. 16, 1990

[54] PORTABLE SPA

[76] Inventor: Pierce M. Murphy, N 1189 Continental La., LaCross, Wis. 54601

[21] Appl. No.: 176,646

[22] Filed: Apr. 1, 1988

[51] Int. Cl.[4] ..... E04H 3/18

[52] U.S. Cl. ..... 4/493; 4/509; 4/585

[58] Field of Search ..... 4/488, 492, 493, 506–509, 4/538, 541–545, 567–569, 571–573, 575, 578–581, 584–590, 592–594; 52/2 R, 2 J, 2 K, 2 H; 441/1, 30, 44; 128/66; 297/DIG. 3, 180

[56] References Cited

U.S. PATENT DOCUMENTS

| | | | |
|---|---|---|---|
| 1,669,773 | 5/1928 | Ober | 4/545 |
| 2,080,601 | 5/1937 | Cappuccio | 4/580 |
| 2,602,935 | 7/1952 | Phillips | 4/584 |
| 2,718,014 | 9/1955 | Mizrach et al. | 4/506 |
| 3,166,799 | 1/1965 | Birnkrant | 52/2 R |
| 3,330,598 | 7/1967 | Whiteside | 297/DIG. 3 |
| 3,488,782 | 1/1970 | Billig et al. | 4/506 |
| 3,869,736 | 3/1975 | Valois et al. | 4/506 |
| 4,019,210 | 4/1977 | Patterson et al. | 4/492 |
| 4,150,665 | 4/1979 | Wolfson | 4/493 |
| 4,547,919 | 10/1985 | Wang | 4/588 |

FOREIGN PATENT DOCUMENTS

| | | | |
|---|---|---|---|
| 0215514 | 3/1987 | European Pat. Off. | 4/542 |
| 2132334 | 7/1984 | United Kingdom | 297/180 |

*Primary Examiner*—Henry J. Recla
*Assistant Examiner*—J. Casimer Jacyna
*Attorney, Agent, or Firm*—Warren A. Sturm

[57] ABSTRACT

A portable spa having a vertically rigid side wall, and a flexible inner including inflatable seat chambers which may be connected in series for filling with a fluid and inflatable backrest chambers which are partially filled with fluid and air.

19 Claims, 5 Drawing Sheets

PORTABLE SPA

BACKGROUND OF THE INVENTION

1. Field of the Invention

This invention relates to baths and spas and more particularly relates to a collapsible portable spa.

2. Description of the Prior Art

In the present state of the art,spas, for personal bathing or other treatments, such as heat or jet whirlpool application of a fluid on to the body of a user, have been provided with a unitary structure in which a tank for receiving water or the like is defined by an enclosure which includes various and sundry ducts or tubes for conveying and recirculating the fluid contained in the enclosure and have surfaces for supporting the user, such as seats and the like.

Spas are currently available in packages which are intended to be built in to or disposed on an existing structure or may, as in some applications, be disposed on wheels so that the entire unitary structure may be transported from one location to another.

SUMMARY OF THE INVENTION

My invention is directed to a portable spa comprised of a foldable side wall and a foldable flexible liner to be disposed into and over the side wall and, when filled with an appropriate liquid, for receiving a user.

The side wall is generally cylindrical in shape and is comprised of a suitable material that is essentially vertically and circumferentially rigid.

At least one liner comprised of flexible material, is configured to be disposed on, within and over the side wall and includes a plurality of inflatable chambers suitably positioned to serve as seats and backrests to support a user after the spa has been filled with the appropriate fluid, as will be set forth below.

A fluid circulation system including an intake and a plurality of outlet manifolds may be easily disposed within the liner for conditioning and directing the flow of the fluid onto or about a user and a suitable electric heater may be disposed underneath the bottom of the liner for controlling the temperature of the fluid in the spa, or bath. A pump for the fluid circulation is connected to the intack and outlet manifolds through suitable tubing and need not includie provisions for heating or cooling the fluid.

A method of erecting the portable spa of my invention comprises the filling of predetermined inflatable chambers in a sequence which provides the proper disposition and capacity for each of the chambers as individual units to support an individual user when the spa is filled with the desired fluid, such as water.

DETAILED DESCRIPTION OF THE ILLUSTRATED EMBODIMENT

Figure 1:
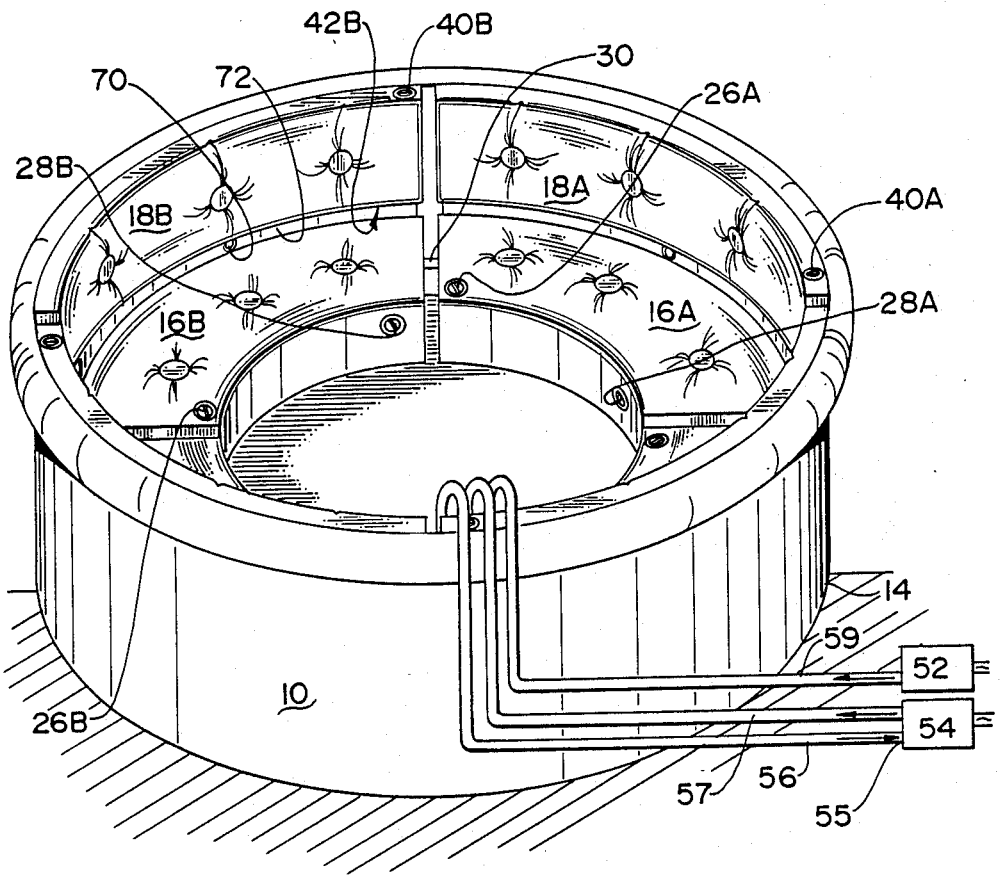
FIG. 1 is a perspective view of a spa embodying the principles of my invention.
Figure 2:
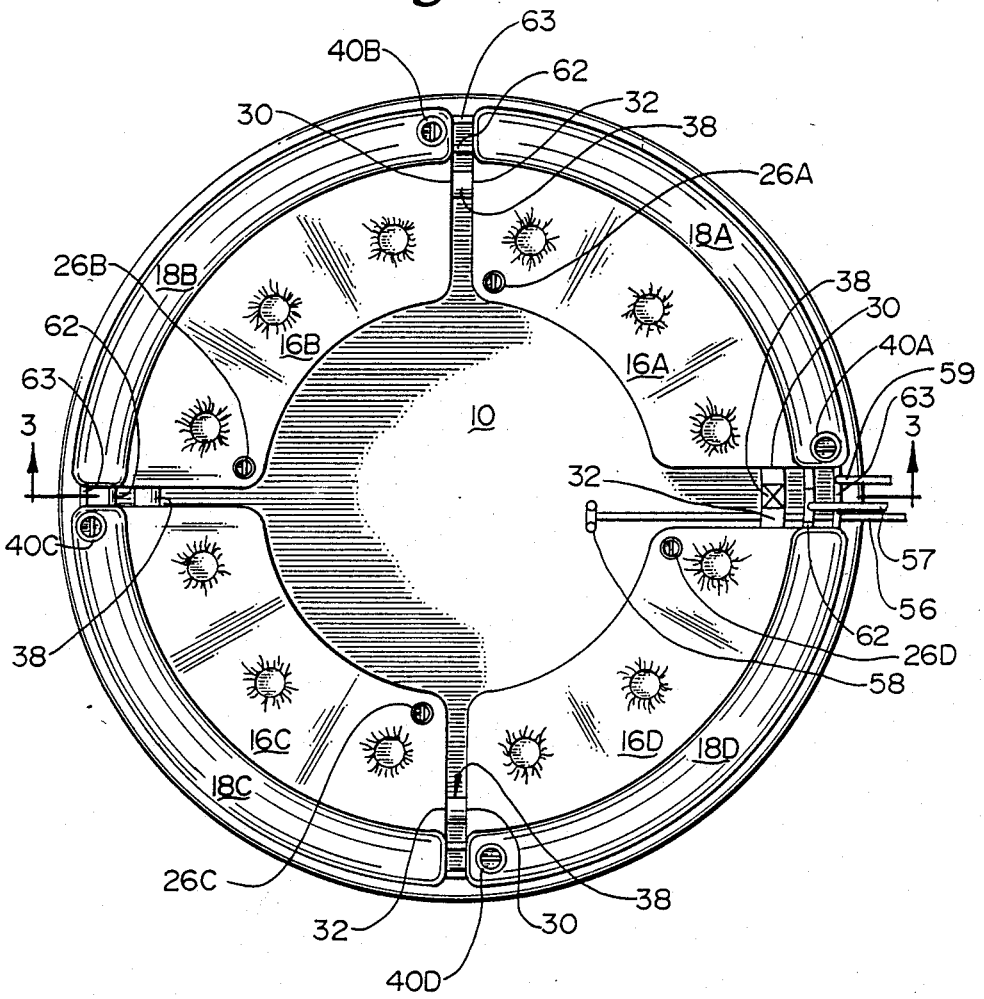
FIG. 2 is a top plan view of the spa illustrated in FIG. 1.
Figure 3:
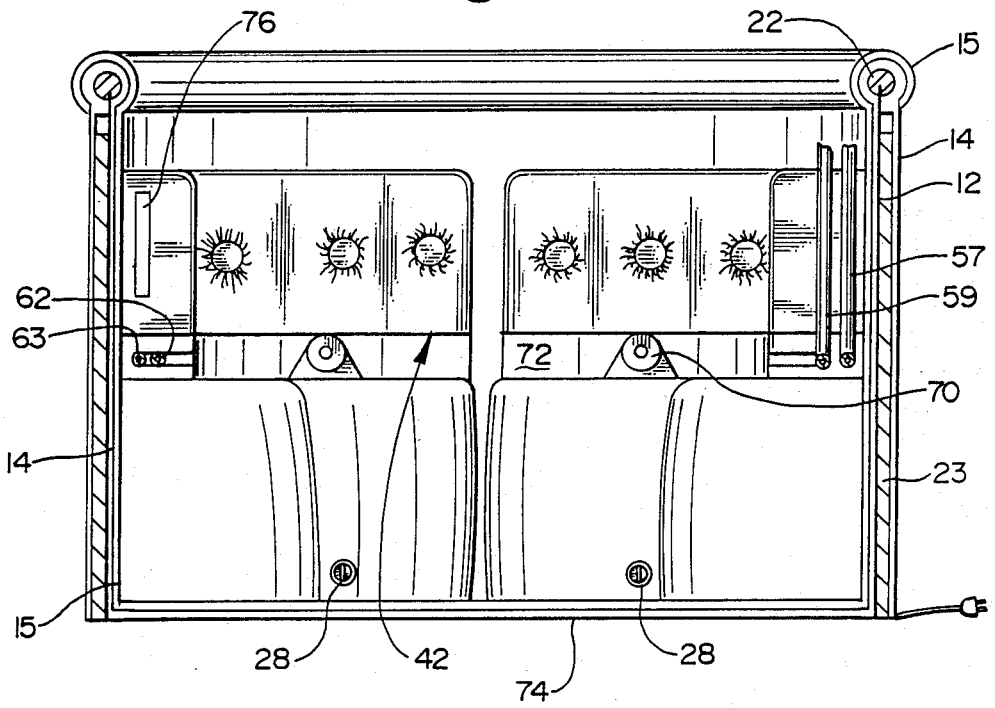
FIG. 3 is a sectional view taken along section lines 3—3 on FIG. 2 of the drawings.
Figure 4:
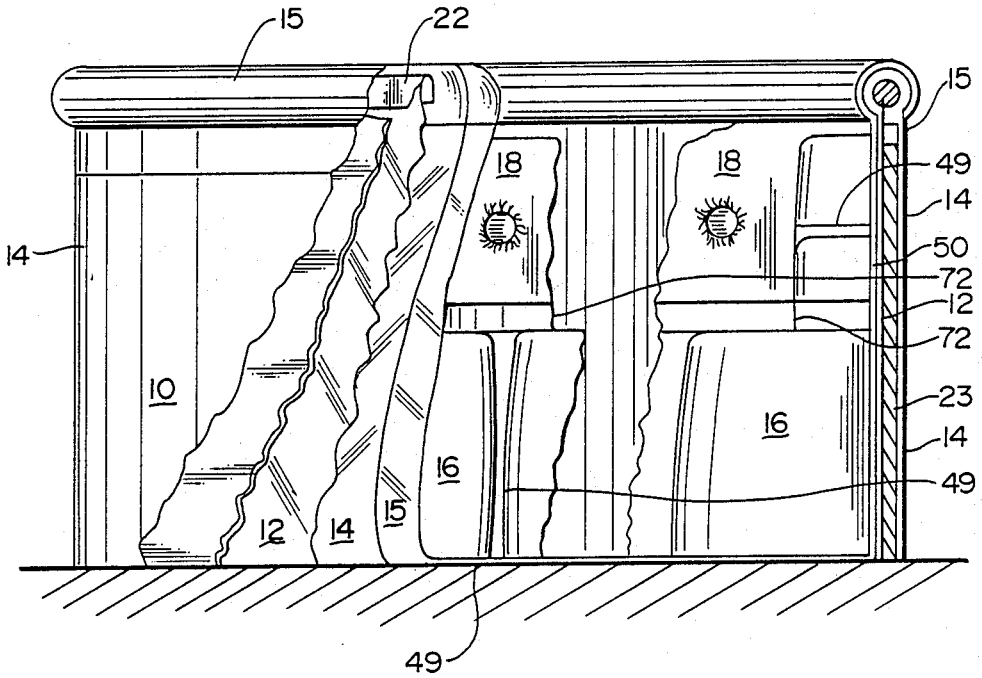
FIG. 4 is a side elevational view partially broken away and partly sectional to illustrate the relationships and disposition of the various elements of my invention as embodied in the spa.

Referring to the drawings, my portable spa is indicated generally by reference character 10 and is comprised of a side wall unit 12 over which are disposed outer and inner liners 14 and 15 to define a generally cylindrical spa or bath unit for receiving a quantity of suitable fluid and one or more users or bathers.

When in a operative position, side wall 12 assumes a generally open-ended cylindrical configuration for receiving the liners and liquid or fluids contained therein. Side wall 12 may be comprised of a material that exhibits substantial rigidity along two planes but is flexible in a third plane as, for example, commonly found in a sheet of fiberglass material impregnated with a suitable plastic. Side wall 12 may be manufactured in two or more rectangular sections suitably secured together as by screw threaded fasteners (not shown) so that the panels may be disassembled and transported individually or the entire unit may be folded longitudinally for transportation from one location to another. In one operative embodiment of my invention, side wall 12 was comprised of ⅛ inch thick plastic impregnated fiberglass of approximately 32 inches high and, when assembled, 77 inches in diameter.

A continuous padding ring, 22, of resilient, sponge-like material is shown disposed on the top of side wall 12 and may be comprised of expanded polyethylene insulation or the like. Padding ring 22 is provided with a downwardly opening slot for engagement with and to be supported from the top periphery of side wall 12.

Similarly, a continuous layer of insulation 23 is shown disposed adjacent the inner side of side wall 12 to aid in preventing loss of heat from the fluid that may be contained within spa 10. Insulation 23 may be comprised of a suitable expanded polyethylene material or the like.

My spa is shown in assembled operating relationship as having inner and outer liners 15 and 14 respectively. Outer liner 14 is comprised of a continuous layer of vinyl material approximately 10 mils in thickness and includes a circular bottom portion, an upwardly extending side wall portion of generally cylindrical configuration, and a downwardly extending side portion, extending continuously up to, over and downwardly from the top of side wall 12 and padding ring 22.

Inner liner 15 is similarly constructed of flexible vinyl material and is of approximately 15 mils in thickness. Inner liner 15 has a circular bottom portion and an upwardly extending, cylindrically configured side portion which extends upwardly and over the top of liner 14, and down the outside portion of side wall 12 for a short distance.

A plurality of lower support members for the user of the spa are shown in the form of seat chambers 16A, 16B, 16C, and 16D, each having an upper 26A, 26B, 26C and 26D and lower valve 28A, 28B, 28C and 28D and side openings 30 and 32. Seat chambers 16A, 16B, 16C and 16D are disposed around the bottom peripheral portion of inner liner 15 and each is comprised of a layer of like material sealably disposed on adjacent inside bottom and side portions of liner 15 to form a complete arcuate chamber having the upper and lower valves 26 and 28 described above as well as the pair of side valves 30 and 32, disposed adjacent the top rear side portions of the seat chambers. Adjacent side openings are interconnected by suitable tubing, which may preferably include valve 38, for purposes to be explained below.

A similar number of backrest chambers 18A, 18B, 18C and 18D extend inwardly of the inside top of inner liner 15 over and above seat chambers 16A-D. Each backrest or chamber 18 is similarly comprised of a layer of polyvinyl plastic of the same thickness and are attached to the inner surface of the side portion of inner liner 15 to form the generally arcuately shaped rectangular backrest for the users of the spa. Backrest chambers 18 are likewise provided with upper valves 40A, 40B, 40C and 40D and lower valves 42A. 42B, 42C and 42D disposed on the top and bottom surfaces thereof and a vertically extending transparent sight tube portion 76, for observing the level of liquids within the backrests, extending vertically of one or the other circumferentially spaced, side portions for purposes to be explained below.

It may now be appreciated that outer liner 14 and inner liner 15 may, when emptied, be conveniently folded into a compact manageable package for transportation between various locations.

The front and rear major surfaces of backrests 18 and the top and bottom surfaces of seat chambers 16 may be suitably interconneted a plurality of spaced shape retention means shown in the form of by flexible restraint members 49 to prevent undue displacement of the surface in one direction or another as determined by the location of the restraint. In one operative embodiment, restraint members 49 were comprised of circular tubular members of an inextensible flexible plastic material the same as inner liner 15, suitably attached at either end to a surface of a chamber and to the bottom or side wall of inner liner 15. Other configurations therefor may occur to those skilled in the art.

A skirt 72 is shown depending from the bottom forward edge of backrest chambers 18 for purposes to be described below.

As may be desired by a user and/or of necessity for hygienic purposes, a recirculation and filtering system may be easily disposed on and about my spa 10. As illustrated on the drawings, a fluid pump 54 is connected through an inlet tube 56 up and over the side wall and down to the bottom of inner liner 15 to connect with "T" shaped pump inlet member 58 and to a circular ring manifold 62 through tube 57 and T shaped member 60 for filtering and recirculation of the fluid through jet nozzles 70, appropriately connected to manifold ring 62 at desired locations. It may be noted that manifold ring 62 is disposed adjacent the top rear portion of seat chambers 16 and is substantially hidden from view by skirt 72 extending from the bottom forward edge of backrest chambers 18. Similarly, an air compressor 52 is connected through tube 59 up and over the top of spa 10 and downwardly into fluid transmitting relationship with a further manifold ring 63 also disposed adjacent the upper rear portions of seat chambers 16, for connection to nozzles 70 to provide a jet of air entrained water for therapeutic and other purposes.

Figure 5:
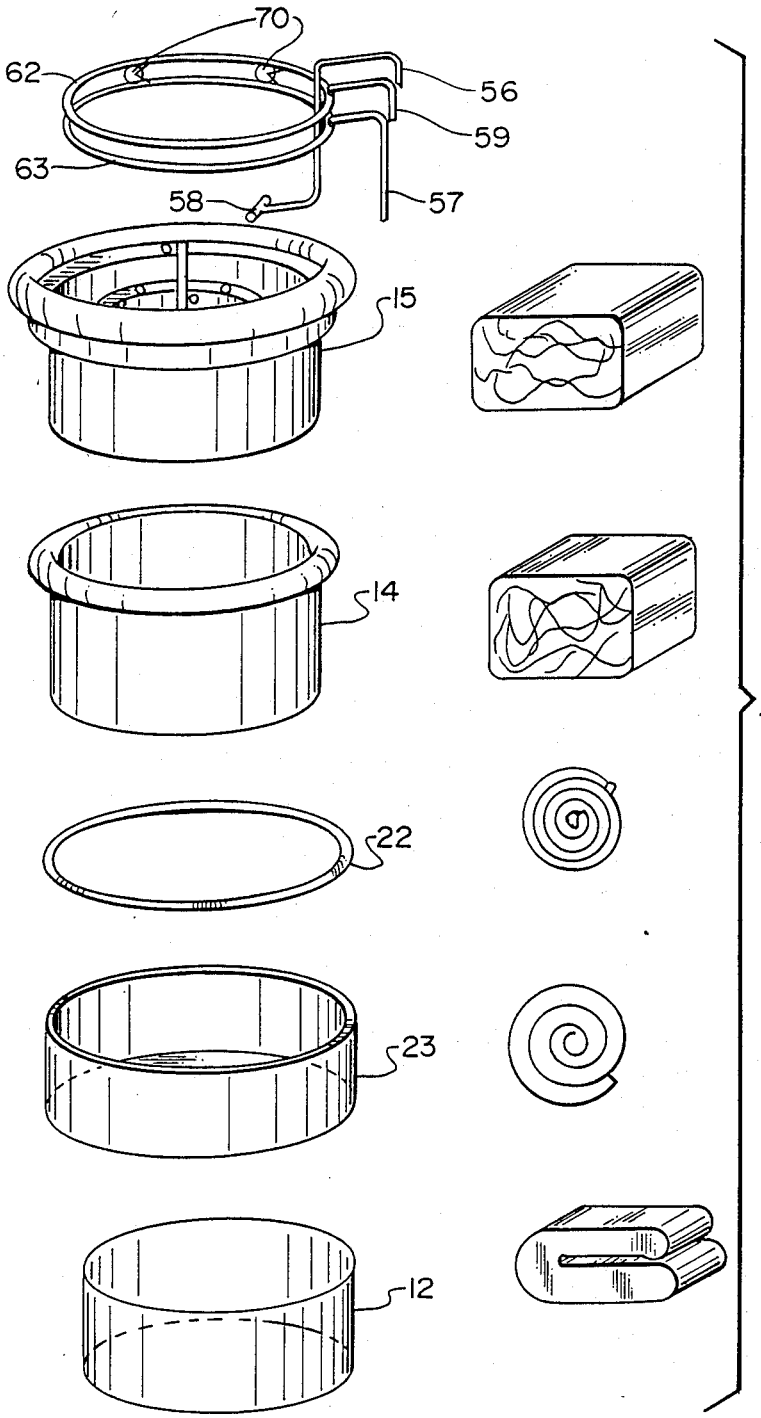
FIG. 5 is an exploded perspective sketch showing the relationship of the elements of the illustrated embodiment of the invention in the order of assembly and incuding a representative transport configuration for element.

In the exploded sketch of FIG. 5, the respective elements of my portable spa are shown in vertical spaced apart relationship at the left side and in their folded transporting relationship at the right side.

OPERATION OF THE ILLUSTRATED EMBODIMENT

The operation of my portable spa 10 includes the method of installation to provide user support structure in the form of seat and backrest chambers to comfortably support one or more individuals after the spa has been filled.

Assuming the spa is in a disassembled transport configuration, side wall 12 is unfolded or reconnected to provide an upstanding generally cylindrical configuration on top of substantially flat surface having sufficient structural characteristics to support the weight of the spa when full of water. An electrical resistance heater 74 is disposed in the open center portion, padding ring 22 is disposeed on top of sidewall 12, insulation layer 23 is disposed around sidewall 12, outer liner is unfolded and disposed over and about side wall 12 to form a continuous surface from the interior thereof up and over the sides and down the outsides to the floor surface and inner liner 15 is similarly disposed on top of outer lining 14.

The remaining step involves the method of filling spa 10 so that the seat and backrest chambers 16A-D and 18A-D are erected or inflated to assume a desired degree of support for the users.

Initially, all of the lower valves 28A-D on seat chambers 16A-D are closed. The upper valves on chambers 16B and 16C are closed and the valve 38 extending between side openings 30 and 32 on chambers 16A and 16D are closed and the remainder of valves 38 are open to allow free communication intermediate the serial combination from upper valve 26A on chamber 16A to 16B to 16C to upper valve 26A on chamber 16D. A hose or the like is attached to upper valve on chamber 16A. When chamber 16A is full, the water will flow into chamber 16B and similarly sucessively into chambers 16C and 16D to completely fill all of the seat chambers. At this point, the open upper valve 26D on chamber 16D is closed and the hose is removed from upper valve 26A on chamber 16A and the valve 26 is closed. Any of valves 38 remaining open are then closed and it may be seen that each chamber is now completely filled with water and is isolated from the others so that, for example, a large difference between the weights of two or more users resting on individual seats will not cause liquid to flow intermediate the seat chambers.

Spa 10 is then completely filled with water in the interior and at this time, each of the backrest chambers 18A–18D may be lightly inflated with air and both upper and lower valves 40A–D and 42A–D closed so that backrest chambers 18A–18D tend to float on top of the surface of, and be immersed within, the water in the spa as the liquid rises to the desired level. As this is occuring, lower valves 42 on backrest chambers 18A–18D are opened to allow the liquid to enter each of the chambers from the bottom. The level of the liquid within each of the chambers may be readily observed on sight tube 76. During this latter portion of the filling cycle of spa 10, the liquid level in the central portion and that contained within the backrest chambers is essentially the same and it is desirable to have the same level of fluid throughout so as to permit the backrest chambers to assume a comfortable firmness for the users. Subsequent to attaining the desired liquid level, lower valves 42 are closed and the amount of air in the upper half of backrest chambers 18 may be adjusted for individual preferences by opening upper valves 40 and adjusting the air pressure therein.

I claim:

1. A method of filling the seat chambers of a fluid filled spa of the class having a plurality of inflatable backrest and seat chambers comprising the steps of (a) connecting a source of fluid to the top of the first of said plurality of seat chambers;

(b) serially interconnecting successive seat chambers;

(c) venting the top of the last of said seat chambers;

(d) filling said seat chambers with fluid until the desired firmness of said seat chambers is achieved;

(e) filling said spa with fluid to a desired level;

(f) partially filling said backrest chambers with fluid to a height substantially equal to the height in said spa; and (g) inflating said backrest chambers with air until the desired firmness of said backrest chambers is reached.

2. A fluid containing portable spa comprising (a) a vertically, circumferentially rigid, upstanding side wall having an open cylindrical configuration;

(b) a flexible liner disposed over and within said side wall and including a plurality of inflatable seat chambers disposed on the bottom of said liner and a plurality of inflatable backrest chambers disposed peripherally around the upper interior thereof, each of said seat and backrest chambers having selectively operable access valve means disposed on upper and lower portions, thereof and each of said seat chambers having interconnecting selectively operable valve means disposed adjacent the side portions thereof.

3. The spa as claimed in claim 2 having a plurality of spaced shape retention means within said backrest chambers, said shape retention means extending intermediate the front and back of said backrest chamber.

4. The spa as claimed in claim 3 including an electrical resistance heater means disposed under said liner for maintaining said fluid at a predetermined temperature.

5. The spa as claimed in claim 3 having a plurality of jets adapted to be connected to a source of fluid or gas under pressure distributed throughout the interior of the hot tub.

6. The spa as claimed in claim 2 having a plurality of spaced shape retention means within said seat chambers, said shape retention means extending from the top to the bottom thereof.

7. The spa as claimed in claim 6 including an electrical resistance heater means disposed under said liner for maintaining said fluid at a predetermined temperature.

8. The spa as claimed in claim 6 having a plurality of jets adapted to be connected to a source of fluid or gas under pressure distributed throughout the interior of said hot tub.

9. The spa as claimed in claim 2 having said seat chambers having interconnection valve means between said seat chambers controlling fluid flow between said seat chambers.

10. The spa as claimed in claim 5 having a plurality of spaced shape retention means within said backrest chambers, said shape retention means extending intermediate the front and back of said backrest chamber.

11. The spa as claimed in claim 9 having a plurality of spaced shape retention means within said seat chambers, said shape retention means extending from the top to the bottom thereof.

12. The interconnecting valve means as claimed in claim 9 whereby each seat chamber can effectively be isolated from the rest of said chambers and the softness of each of said seat chambers can be independently determined.

13. The spa as claimed in claim 12 having a plurality of spaced shape retention means within said backrest chambers, said shape retention means extending intermediate the front and back of said backrest chamber.

14. The spa as claimed in claim 12 having a plurality of spaced shape retention means within said seat chambers, said shaped retention means extending from the top to the bottom thereof.

15. The spa as claimed in claim 12 including an electrical resistance heater means disposed under said liner for maintaining said fluid at a predetermined temperature.

16. The spa as claimed in claim 12 having a plurality of jets adapted to be connected to a source of fluid or gas under pressure distributed throughout the interior of said hot tub.

17. The spa as claimed in claim 2 including an electrical resistance heater means disposed under said liner for maintaining said fluid at a predetermined temperature.

18. The spa as claimed in claim 17 having a plurality of jets adapted to be connected to a source of fluid or gas under pressure distributed throughout the interior of said hot tub.

19. The spa as claimed in claim 2 having a plurality of jets adapted to be connected to a source of fluid or gas under pressure distributed throughout the interior of said hot tub.

* * * * *